US007448300B2

(12) United States Patent
Barniak, Jr.

(10) Patent No.: US 7,448,300 B2
(45) Date of Patent: Nov. 11, 2008

(54) 360 DEGREE ROTATABLE RATCHET SOCKET DRIVE BODY TAPERED FOR VARIOUS AXIALLY DRIVEN EXTERNAL DRIVING COMPONENTS

(76) Inventor: Thomas John Barniak, Jr., 6011 Lance Rd., Medina, OH (US) 44256

( * ) Notice: Subject to any disclaimer, the term of this patent is extended or adjusted under 35 U.S.C. 154(b) by 0 days.

(21) Appl. No.: 11/811,405

(22) Filed: Jun. 11, 2007

(65) Prior Publication Data

US 2008/0173142 A1 Jul. 24, 2008

Related U.S. Application Data

(60) Provisional application No. 60/881,498, filed on Jan. 22, 2007.

(51) Int. Cl.
*B25B 13/46* (2006.01)
*B25B 13/48* (2006.01)
*B25B 13/06* (2006.01)

(52) U.S. Cl. ..... 81/124.2; 81/176.2; 81/60; 81/121.1

(58) Field of Classification Search ..... 81/124.2, 81/176.2, 29, 488, 489, 60, 63, 63.2, 121.1; D8/25, 83

See application file for complete search history.

(56) References Cited

U.S. PATENT DOCUMENTS 2,565,961 A * 8/1951 Godfrey ..... 192/43
3,823,624 A * 7/1974 Martin ..... 81/58.1
D255,979 S * 7/1980 Boursaw ..... D8/25
D292,771 S * 11/1987 Kim ..... D8/25
4,748,874 A * 6/1988 Sharp et al. ..... 81/58.1
4,791,837 A * 12/1988 Main ..... 81/63.1
5,005,448 A * 4/1991 Main ..... 81/63
D337,246 S * 7/1993 Arden ..... D8/25
6,079,298 A * 6/2000 Gasperi et al. ..... 81/63.1
6,138,531 A * 10/2000 Lamons ..... 81/60
6,286,395 B1 9/2001 Frazier
6,343,530 B1 2/2002 Huang
D467,154 S * 12/2002 Song ..... D8/107
D470,369 S * 2/2003 Byram et al. ..... D8/25
6,935,212 B2 8/2005 Wadsworth
6,976,408 B2 * 12/2005 Chen ..... 81/60
7,137,318 B2 11/2006 Falzone
D540,644 S * 4/2007 Song ..... D8/70
2002/0162422 A1 11/2002 Kerzher

OTHER PUBLICATIONS

The Stanley Works—Online Tool Catalog—Jun. 7, 2007.

* cited by examiner

*Primary Examiner*—David B Thomas

(57) ABSTRACT

A total wrench structure consisting of two mated structures in combination with a drive tool for the manipulation of fastener heads. A ratchet gear is contained in the first structure of a shape suitable to be slidably mated and loosely locked thereunto the second structure which contains a means for torquing introduction and implementation by a drive tool. The total wrench structure can be applied in a piecemeal fashion onto the fastener head in a restricted working space and the choice of drive tool elements that may attach to the second structure axially allows its user to mitigate the aforementioned restricted space while effectively applying the appropriate torque into the total wrench structure applied onto the fastener head. The total wrench structure is capable of 360 degree unrestricted working rotation.

2 Claims, 3 Drawing Sheets

360 DEGREE ROTATABLE RATCHET SOCKET DRIVE BODY TAPERED FOR VARIOUS AXIALLY DRIVEN EXTERNAL DRIVING COMPONENTS

CROSS REFERENCE TO RELATED APPLICATIONS

This application claims the benefits of provisional patent application Ser. No. 60/881,498, filed 2007 Jan. 22 by the present inventor, which is incorporated by reference.

BACKGROUND OF THE INVENTION

1. Field of the Invention

The present invention relates to ratchet socket drive wrenches and more particularly, to their structure bodies and how it relates to their mechanical ratcheting and torquing abilities when used in common and difficult working scenarios.

2. Description of the Related Art

Handled ratchet socket wrenches with various sized squared output drive shafts such as the common ¼, ⅜ and ½ inch drive size are routinely used to drive a steel socket with a correspondingly sized recessed input drive cavity in the mechanical function of loosening and tightening bolt head type fasteners and the like in all types of mechanical working scenarios. This type of handled wrench works well in a working situation whereas there is adequate space for the user to facilitate the side-to-side motion required to activate the ratcheting action of the wrench and that no extreme torque would be needed to 'break free' a 'frozen' fastener head. Unfortunately, mechanical situations are quite common whereas the user finds themselves in a severely limited working space and strong to excessive torque force is needed to 'break' a stubborn fastener. The shortcomings of the handled ratchet are very apparent in especially this type of working mechanical environment due to its body structure limitations and the method in which hand torque is transmitted to the fastener head. The explanation of these facts are as follows: the hand torque applied to the handle of the ratchet wrench by the user is distributed unevenly through the wrench to the fastener head. Exactly stating, the torque force applied to the handle distributes that force in a tangential fashion to the ratchet wrench structure body which distributes that same tangential torque force to the extension bar or socket that is locked onto the wrench output drive shaft. Even if the user has barely enough space to activate the ratcheting action of the wrench with limited wrist action, that user will experience what is known as tangential 'torsion twist' with a stubborn fastener head. At that point, the user must use his or her free hand to stabilize (hold, press) the socket or extension bar so as for the socket to not 'torque' right off of the fastener head, resulting in a 'stripped', rounded or broken fastener head, not to mention the injury that could occur to the hand of the user.

This common mechanical working occurrence just described is due to the fact that handled ratchet wrenches, because they transmit torque force in an uneven tangential manner from the handle, which is disposed at just one location or point on the exterior circumference of the ratchet wrench body structure, is severely limited in its ability to remove and replace fasteners efficiently and effectively. A greater improvement in methodology and apparatus is desired and sought in all mechanical industries that are engendered with bolt head fasteners.

SUMMARY OF THE INVENTION

The present invention mitigates removal and assembly problems that occur with bolt head fasteners with a ratchet socket wrench structure body implementation that eliminates the handle that is used to drive the wrench body tangentially around the internal ratchet wheel in the directional intent desired. Instead, the ratchet wrench structure body is machined or forged in a 360 degree round configuration with the structure body gradually reducing or tapering in circumference in a symmetrical radial fashion to a predetermined length whereas the tapered end point of the wrench body structure is machined or forged for an external wrench body driving component or combination of components.

As a result of the wrench body being tapered symmetrically and inwardly to its predetermined length at an axial centerpoint of the wrench structure body, the total ratchet wrench structure body is enabled to be driven clockwise or counterclockwise in an axial manner by the external driving component engaged into or to its tapered end point. The fact that the wrench structure is being driven in an axial manner means that the torque force being applied, including extreme torque force, is transmuted through the wrench body axially to the bolt head fastener resulting in the torque force being applied equally and evenly to all surface points of the fastener head, eliminating the 'torque twisting' problem effect that is typical with handled ratchet wrenches. Evenly distributed torque force at the fastener head also results in less potential damage to the fastener head and a more effective and save method of loosening and tightening fasteners to the user of the present invention.

A final point transfluent to the present invention which cannot be understated is in the fact that the ratchet wrench body structure is handleless, which means the wrench body can be driven axially in a constant and unimpeded 360 degree rotational turning circumference by its external driving component. This results in smooth and efficient mechanical action inherent to the present invention. More advantages will be apparent after reading the drawings description and operation of the preferred embodiments of the present invention.

DRAWINGS—REFERENCE NUMERALS

| | |
|---|---|
| 10 round ratchet head | 11 tapered body structure |
| 12 tapered termination point | 13 squared output drive shaft-ratchet head |
| 14 pawl directional switch-release | 15 finger opening to directional switch and socket release button-solid structure body embodiment only |
| 16 allen wrench as external driver | 17 a typical steel socket |
| 18 square drive wrench | 19 finger drive pin-optional |
| 20 drive pegs at 90 degree points | 21 cutout locking point at 90 degree points |
| 22 cavity to receive ratchet head-section view-detachable body | |

DETAILED DESCRIPTION AND OPERATION—PREFERRED EMBODIMENTS

Figure 1:
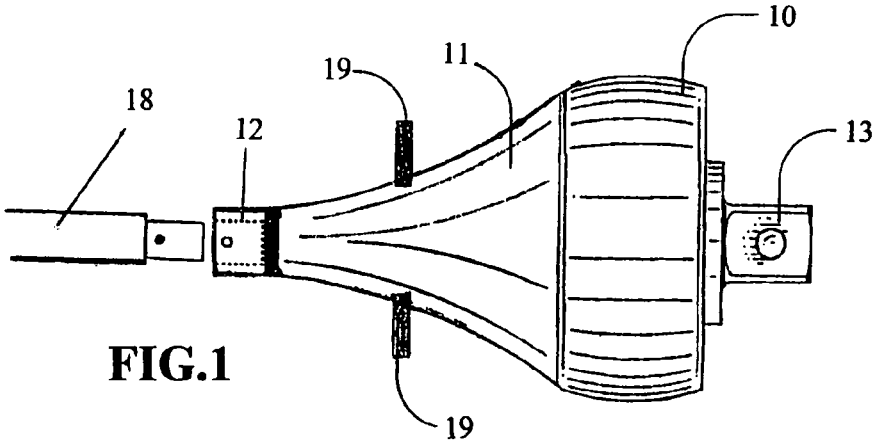
FIG. 1 is a side or top view of the round ratchet socket solid body tapered to an external driving component.
Figure 3:
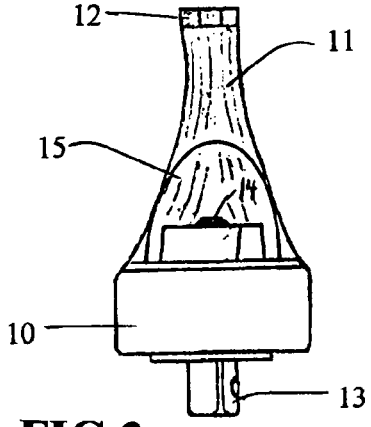
FIG. 3 is a view of the round ratchet socket solid drive body showing how a finger opening space will be included in the solid body structure embodiment.
Figure 2:
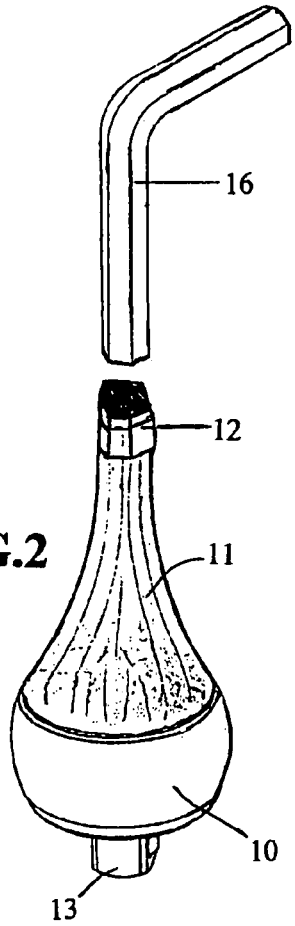
FIG. 2 is a perspective view of the round ratchet socket solid body tapered to another drive termination point.
Figure 4:
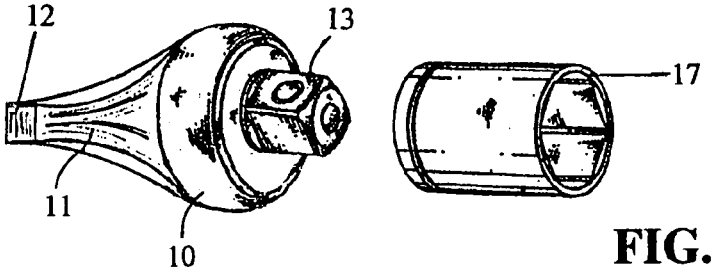
FIG. 4 is a perspective view of the round ratchet socket solid drive body with typical steel socket.

The preferred embodiment of the present invention in a solid forged or machined one-piece structure body is illustrated in FIGS. 1-4. The steel encasing the round ratchet head 10 starts to taper in a symmetric fashion towards its axial centerpoint which results in the tapered body structure 11. At the predetermined termination point 12, the tapered body is forged or machined to receive its external driving component; FIG. 1, a square drive wrench 18—FIG. 2, an allen wrench 16. Since the preferred embodiment is of a solid steel body, an opening in the tapered body 15, sufficient in size to allow a human finger to pass through and activate the pawl directional switch and socket release button 14, is shown in FIG. 3. After the user of the present invention locks a correspondingly sized typical steel socket 17 onto the squared output drive shaft 13 as shown in FIG. 4, the total tapered ratchet socket drive structure body is capable of a full constant 360 degree rotational turning ability, driven in an axial manner by its external driving component with fully required ansi torque specifications, in any open or restricted space mechanical working condition scenario.

The preferred embodiment of the present invention with a remote ratchet head containing the ratcheting gear, pawl and square drive incorporating a detachable forged or machined tapered drive body structure is illustrated in FIGS. 5-10. The ratchet head 10 is forged or machined with 4 drive pegs at 90 degree points 20 on the circumstantial surface of the ratchet head 10 shown in FIGS. 5-7. The tapered body structure 11 is a separately forged or machined entity of a predetermined size with a termination point 12 forged or machined to a predetermined method of external driving component such as the square drive wrench 18 shown in FIG. 5. Four (4) cutout locking points at 90 degrees 21 are machined at the large diameter end of the tapered body structure 11 on its circumstantial surface and shown in FIGS. 5, 6, 9 and 10 being a section view.

The inside surface of the circumstantial structure at the large diameter end of the tapered body structure 11 will be off a sufficient size to easily slide over the outside circumference of the round ratchet head 10. The cutout locking points at 90 degrees 21 are of a T-shape configuration and are machined into the large diameter side of the tapered body structure 11 in a uniform manner of depth and side dimension so as to slide easily and smoothly past the drive pegs at 90 degree points 20 that are incorporated into the round ratchet head 10. When the drive pegs 20 are fully seated into the uniform depth of the cutout locking points 21, the tapered body structure 11 is turned in a clockwise or counterclockwise intent of directional use and the drive pegs 20 slide in the cutout locking points 21 the short distance to a uniform stopping point, either at the upper right or left side of the T-shaped cutout, therein the round ratchet head 10 is engaged in a locked-in but slidable manner to the tapered body structure 11. The drive pegs 20 will have full surface engagement to the surface structure of the cutout locking points 21 for the required torque driving rotational force required for and by the round ratchet head's output drive size. Once the desired typical steel socket 17 is locked onto the squared output drive shaft 13 contained on the output drive side of the ratchet head 10, the total ratchet socket drive embodiment consisting of the round ratchet head 10 in a locked-in position to the tapered body structure 11 by the nature of its drive pegs 20 held in the confines of the T-shaped cutout locking points 21, can be driven by its designed external driving component in a fully rotational and constantly unimpeded 360 degree arc swing manner even after the socket is placed on the fastener head desired to be loosened or tightened.

A directional intent of the embodiment is accomplished by first setting the pawl directional switch 14 for either a clockwise or counterclockwise position before locking in the round ratchet head 10 to the tapered body structure 11. If the other direction of ratcheting action is desired, the tapered body structure 11 is moved to the neutral or slide on position for the ratchet head 10, whereas the user slides the drive pegs 20 through the neutral position or leg of the T-shaped cutout locking points 21, therein detaching the ratchet head 10 from the tapered body 11. The user accordingly then sets the pawl directional switch 14 or changes the socket 17 at the same switch, if the ratchet head has a release button (optional), and proceeds accordingly to slide the tapered body structure 11 back onto the ratchet head 10, lining up the coinciding drive pegs 20 with the locking points 21 on the two bodies, sliding the drive pegs 20 through the neutral position or leg of the cutout locking points 21 until they are fully seated therein and then slightly turning the tapered body structure 11 in the ratcheting direction intended (clockwise or counterclockwise), therein locking the drive pegs 20 in the cutout locking points 21. The tapered body structure 11 is now locked onto but in a sliding portable manner to the ratchet head 10 and is ready for the ratcheting action on the fastener head. Since the cutout locking points 21 are machined of a uniform depth at all points, the drive pegs 20 will lock at full surface engagement to the cutout locking points 21, giving the total ratchet socket tapered body 11 with ratchet head 10 four 90 degree points of contact for the capability of the torque force required by the size of ratchet drive the ratchet head 10 is manufactured in. The total tapered ratchet socket drive structure body with ratchet head and socket attached is also capable of fully constant unimpeded 360 degree rotational turning ratcheting action in an axial manner driven by its selectively designed external driving component.

Figure 5:
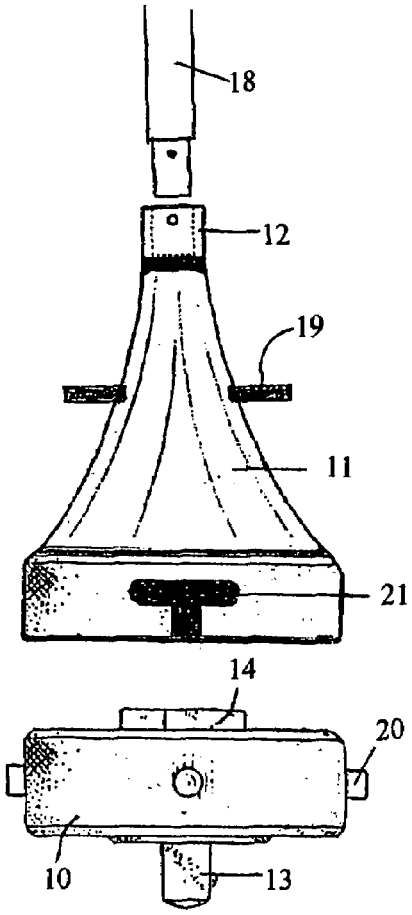
FIG. 5 is a side or top view of the detachable tapered ratchet socket drive body with ratchet head.
Figure 6:
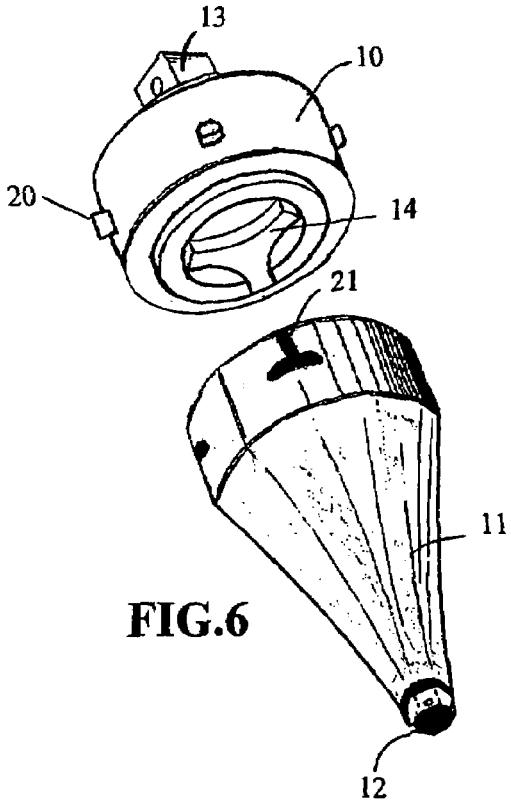
FIG. 6 is a perspective view of the detachable tapered ratchet socket drive body with ratchet head.
Figure 7:
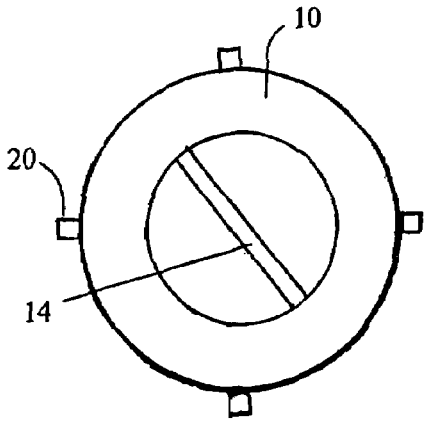
FIG. 7 is a top view of the round ratchet head with four driving peg points on its circumference.

A finger drive pin 19 is shown in FIG. 1 and FIG. 5 as an optional accessory to both a solid and detachable body of the present invention. It consists of a slidable steel pin fitting loosely but in a snuglike manner in and through a hole drilled or machined in a planar line through two opposing sidewalls of the tapered body structure 11. This drive pin 19 allows the user of the present invention to easily grip the tapered body 11 with the fingers at the drive pin 19 so as to start or recede a fastener threading operation by hand before an external driving component is needed for torque force or the drive pin 19 gives an optional overall gripping improvement to the present invention if desired by the operator. Since the tapered body structure 11 is of an easily detachable entity from the ratchet head 10, no finger opening space 15 is necessary in the detachable embodiment disclosed therein.

Figure 8:
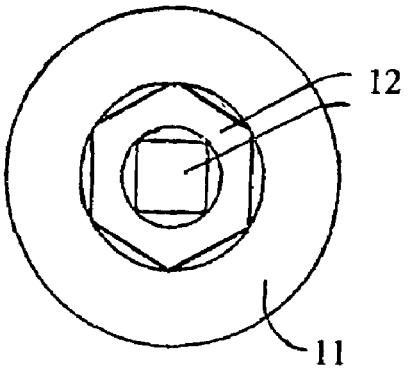
FIG. 8 is a view of the tapered end side of the round ratchet socket drive body showing two axial driving component methods machined into the tapered termination end point of the structure body.
Figure 9:
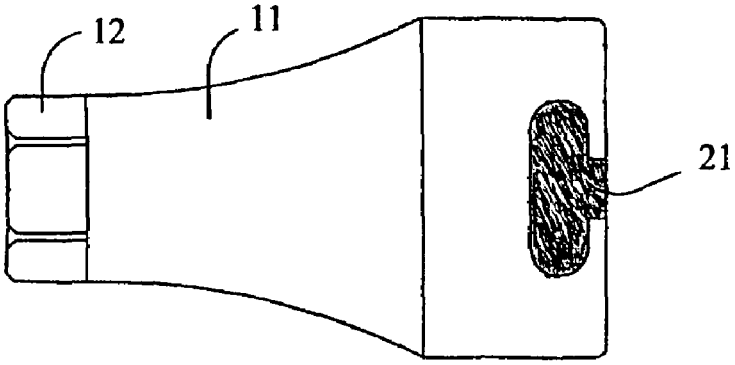
FIG. 9 is a side view of the detachable tapered ratchet socket drive body showing machined cutout at one 90 degree point for locking onto the driving peg of the ratchet head.

FIG. 8 is an end view showing an example of how the tapered termination point 12 can be machined or forged for two methods of axial torquing capabilities and therein, two different embodiments of external driving components; in the view shown, an external hex adaptation of a predetermined size (box or open end wrench) with a cavity therein forged or machined for a square drive wrench or extension bar of a predetermined size. Either of these external axial methods of driving capabilities will function very well and gives the operator of the present invention two options of axial drive that could be used in two different mechanical working condition scenarios.

Figure 10:
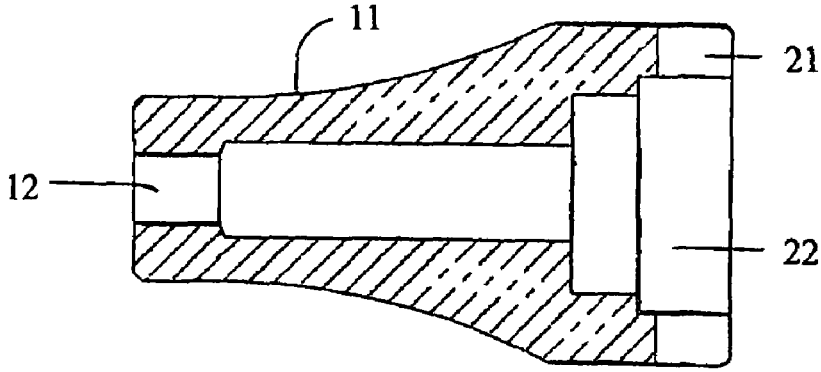
FIG. 10 is a section view of FIG. 9 showing interior cavity for the ratchet head on the full side of the detachable body and cavity for the square drive to be inserted at the tapered end of the body.

FIG. 10 is a section view of an example of a detachable tapered body structure 11 showing its internal cavities, including the cavity that receives the ratchet head 22 that is forged or machined at the larger diameter end of the tapered body structure 11, opposite from the tapered termination end point 12, showing the internal cavity for a square drive wrench or extension bar designed to be the external axial driving component.

The descriptions of the preferred embodiments herein disclosed are only the best examples of the method and the mechanical embodiment apparatuses to accomplish that method known to the inventor at the time of filing and should not be construed as being limiting in the totality of its scope in any perspective pertaining to the present invention.

What is claimed is:

1. A ratchet wrench assembly comprising a remote ratchet head and a detachable tapered drive body structure, said ratchet head containing an internally mounted ratcheting drive mechanism having a drive output member that projects axially from a first side of said ratchet head to engage and drive a work piece; a second side of the ratchet head including a directional switch for setting the ratcheting direction; and said ratchet head further comprising an exterior surface formed of a predetermined geometric shape for circumferential driving engagement thereof; and, said detachable tapered drive body structure comprising an opening forming an axial cavity on a first end thereof and having a diameter of sufficient size to slide over said exterior surface of said ratchet head, wherein said axial cavity of said opening includes a ratchet head engagement portion for mateable engagement to said ratchet head, said ratchet head engagement portion having a predetermined shape complimentary to that of said exterior surface of said ratchet head; said tapered drive body being symmetrical in the radial reduction of its circumferential dimension from said first end to a termination point at a second end of said tapered drive body, said termination point containing a cavity formed on a common axis with said drive output member, whereby engagement with said cavity by a torquing member rotatably drives the said ratchet wrench assembly in an axial fashion.

2. The ratchet wrench assembly of claim 1 wherein said termination point of said tapered drive body structure is of a sufficient circumferential dimension of exterior surface to form a plurality of flat exterior sides orientated along exterior planes which are parallel to said common axis for engagement with a torquing member to rotatably drive the said ratchet wrench assembly.

* * * * *